United States Patent [19]

Lorenzen

[11] Patent Number: 4,856,539

[45] Date of Patent: Aug. 15, 1989

[54] METHOD OF AND APPARATUS FOR UNIFORMIZING THE MOISTURE CONTENT OF TOBACCO

[75] Inventor: Heinz-Christen Lorenzen, Wentorf, Fed. Rep. of Germany

[73] Assignee: Körber AG, Hamburg, Fed. Rep. of Germany

[21] Appl. No.: 938,280

[22] Filed: Dec. 5, 1986

[30] Foreign Application Priority Data

Dec. 7, 1985 [DE] Fed. Rep. of Germany ..... 3543358

[51] Int. Cl.[4] ..... A24C 5/14

[52] U.S. Cl. ..... 131/290; 131/84.1; 131/84.4; 131/303

[58] Field of Search ..... 131/84.1, 84.4, 290, 131/303

[56] References Cited

U.S. PATENT DOCUMENTS 4,185,644 1/1980 Heitmann et al. ..... 131/109.1

FOREIGN PATENT DOCUMENTS 2211520 9/1973 Fed. Rep. of Germany .

*Primary Examiner*—V. Millin

*Attorney, Agent, or Firm*—Peter K. Kontler

[57] ABSTRACT

The moisture content of the fillers of cigarettes is maintained at a preselected value by feeding to the stream building zone of the cigarette rod maker a flow of tobacco particles whose moisture content exceeds the desired value and with a surplus which is removed by an adjustable trimmer to convert the flow into a trimmed stream which is ready for draping into a web of cigarette paper to form a cigarette rod which is subdivided into cigarettes of desired length. The removed surplus is heated by a drying device and the heated surplus with its reduced moisture content is returned into the distributor of the cigarette rod maker to be admixed to the already advancing flow of fresh tobacco particles whose moisture content is excessive. The heating action is regulated as a function of signals generated by one or more moisture detectors which can monitor the moisture content of fibrous material in the surplus prior or subsequent to drying and/or the moisture content of the filler or trimmed stream.

26 Claims, 4 Drawing Sheets

METHOD OF AND APPARATUS FOR UNIFORMIZING THE MOISTURE CONTENT OF TOBACCO

BACKGROUND OF THE INVENTION

The invention relates to improvements in methods of and in apparatus for regulating the moisture content of tobacco in cigarettes, cigars, cigarillos or other rod-shaped smokers' products. More particularly, the invention relates to improvements in methods of and in apparatus for uniformizing the moisture content of fillers in rod-shaped smokers' products or of any other fibrous materials which are used in the tobacco processing industry.

The following description of the invention will deal primarily or exclusively with the making of cigarettes. However, it is to be understood that the method and apparatus of the present invention can be used with equal or similar advantage for the making and treatment of other rod-shaped or otherwise configurated smokers' products.

In the making of cigarettes, the distributor or hopper of a cigarette rod making machine turns out a continuous flow of moist tobacco which normally contains a surplus of moisture and which also contains a surplus of tobacco particles. Therefore, it is necessary to equip the cigarette maker with a trimming or equalizing device which removes the surplus so as to convert a portion of the flow into a trimmed stream which is ready for conversion into the filler of a continuous cigarette rod. It is further necessary to reduce the moisture content of the stream so as to ensure that the moisture content of tobacco particles in the filler of the cigarette rod (and hence in the fillers of discrete plain cigarettes) will match or closely approximate the desired optimum value.

German Offenlegungsschrift No. 22 11 520 discloses a method of and an apparatus for uniformizing the moisture content of a filler which is to be confined in a web of cigarette paper or other suitable wrapping material. The initial moisture content of tobacco particles which enter the distributor of the rod making machine exceeds the desired value. The apparatus is intended to be designed in such a way that automatic and/or intentionally induced drying of tobacco particles during travel through the machine should ensure a desired reduction of the moisture content ahead of the draping station. Thus, some drying of tobacco particles is expected to take place in the course of the classifying operation (this involves segregation of fragments of ribs or other heavier particles from shreds of tobacco leaf laminae), and additional drying of tobacco particles is expected to take place during transport toward the stream building zone. The aforementioned German printed application further proposes to enhance the likelihood of a reduction of the moisture content of tobacco particles to a desired value by monitoring the moisture content of tobacco particles ahead of the stream forming station and by heating the entire mass of tobacco particles which are to advance to the stream forming zone by one or more currents of heated air. The temperature of drying air is regulated in dependency on the results of the moisture monitoring operation.

A drawback of the just discussed method and apparatus is that the reduction of moisture content of tobacco particles is premature, i.e., the particles undergo a pronounced drying action well ahead of the station where the filler of tobacco particles is draped into a web of cigarette paper. This is undesirable because tobacco particles having a relatively high moisture content are less likely to be comminuted than relatively dry tobacco particles, i.e., the percentage of short tobacco and other undesirable fragments of tobacco leaves which are admitted into the distributor is lower if the moisture content of tobacco particles is reduced at a late or very late stage of conversion into the filler of a cigarette rod. Comminution of tobacco particles can take place at a plurality of locations in the interior of a modern distributor wherein the particles are acted upon by carded conveyors, picker rollers and other devices which spear, propel and/or otherwise manipulate the particles on their way toward the tobacco stream building zone. The filling power of a filler which consists primarily of long or reasonably long shreds of tobacco leaf laminae is much more satisfactory than that of a filler which contains a relatively high percentage of short tobacco.

Another drawback of presently known proposals to uniformize the moisture content of tobacco particles in the filler of a cigarette rod or in the fillers of discrete cigarettes is that such known undertakings fail if the moisture content of tobacco which enters the distributor fluctuates within a rather wide range. Mere drying with heated air is not always sufficient to reduce the moisture content to a desired value, and such drying may be too pronounced if the initial moisture content of tobacco particles is rather low.

OBJECTS AND SUMMARY OF THE INVENTION

An object of the invention is to provide a novel and improved method of regulating the moisture content of tobacco particles or other fibrous material in a cigarette rod making or other tobacco processing machine in such a way that the moisture content of the material is reduced to the desired optimum value only immediately or closely ahead of the draping station.

Another object of the invention is to provide a method which can be practiced with advantage irrespective of the extent to which the initial moisture content of fibrous material deviates from the desired moisture content of such material in the fillers of plain cigarettes or other smokers' products.

A further object of the invention is to provide a simple and inexpensive method which renders it possible to reliably maintain the final moisture content of fibrous material at or very close to the desired value.

An additional object of the invention is to provide a method which renders it possible to dispense with intensive heating of air which is used, or which can be used, to transport fibrous material through the distributor and toward the stream building zone of a rod making or other tobacco processing machine.

Still another object of the invention is to provide a method which can be practiced by taking into consideration a number of parameters that do, or can, influence the moisture content of the final products.

A further object of the invention is to provide a novel and improved mode of treating the surplus which is removed from a stream of fibrous material in a rod making or like machine.

An additional object of the invention is to provide a novel and improved apparatus for the practice of the above outlined method and to construct and assemble the apparatus in such a way that fibrous material which is to form the filler of a cigarette rod or the like contains much more than the desired final percentage of moisture all the way, or very close, to the draping station.

A further object of the invention is to provide a cigarette rod making machine which embodies the above outlined apparatus.

Another object of the invention is to provide a production line including one or more rod makers which embody apparatus of the above outlined character.

A further object of the invention is to provide a distributor which can be used in conjunction with the above outlined apparatus.

An additional object of the invention is to provide novel and improved means for drying tobacco in the above outlined apparatus.

Still another object of the invention is to provide the apparatus with novel and improved means for treating the surplus which is removed from a continuous flow of fibrous material in order to convert the flow into the filler of a cigarette rod or the like.

One feature of the invention resides in the provision of a method of maintaining at a predetermined value the moisture content of fibrous material (e.g., particles of tobacco leaves) which is used in the tobacco processing industry. The method comprises the steps of establishing and maintaining a supply of fibrous material with a moisture content exceeding the predetermined value (the source can constitute an upright duct or a magazine in the distributor or hopper of a cigarette rod making machine), advancing a flow of fibrous material from the source in a predetermined direction along a predetermined elongated path, converting a portion of the flow into a smokers' product (e.g., into a continuous wrapped cigarette rod which is thereupon subdivided into plain cigarettes of unit length or multiple unit length) in a first portion of the path (e.g., close to the end of the path) so that the remainder of the flow constitutes a surplus of fibrous material, removing the surplus from the aforementioned portion of the flow in a second portion of the path upstream of the first portion, heating the surplus so as to reduce the moisture content of its fibrous material, and returning the heated surplus into a third portion of the path upstream of the second portion. The returned surplus can be admixed to the fibrous material of the flow so that the moisture content of the flow between the second and third portions of the path is reduced, preferably to the aforementioned predetermined value.

The method preferably further comprises the step of monitoring the moisture content of fibrous material in the flow, and the heating step of such method includes expelling from the fibrous material in the surplus moisture at a rate which is a function of the monitored moisture content.

The returning step preferably includes continuously transporting the surplus along a second path from the second to the third portion of the predetermined path; the predetermined path is or can be considerably longer than the second path.

The monitoring step can include measuring the moisture content of fibrous material in the surplus.

The advancing step preferably includes advancing the flow by suction in a predetermined region of the predetermined path which includes the second portion of such path, and the monitoring step can include measuring the moisture content of the flow in such region of the predetermined path.

The method can further comprise the steps of monitoring the quantity of fibrous material in the surplus and advancing the fibrous material from the source at a rate which is a function of the quantity of fibrous material in the surplus. Such method can further comprise the steps of monitoring the moisture content of fibrous material in the heated surplus and altering the rate of advancement of fibrous material from the source when the moisture content of fibrous material forming the heated surplus drops below a preselected value so that the quantity of fibrous material in the surplus is changed as a result of the altering step. In addition to or instead of the last two steps, the method can further comprise the step of monitoring the quantity of fibrous material in the product (e.g., in plain cigarettes and/or in the cigarette rod) and changing the rate of advancement of fibrous material from the source as a function of changes in the monitored quantity of fibrous material in the product so that the quantity of fibrous material in the surplus is changed accordingly.

The step for monitoring the moisture content of fibrous material in the flow can comprise measuring the moisture content of fibrous material (a) ahead of the second portion of the predetermined path and (b) in the surplus ahead of the third portion of the predetermined path; such method can further comprise the step of changing the rate of advancement of fibrous material from the source in response to changes in the measured moisture content to thereby change the quantity of fibrous material in the surplus.

The step of monitoring the moisture content of fibrous material in the flow can include measuring the moisture content of fibrous material in the heated surplus, and the expelling step can include maintaining the heating action at a fixed value when the moisture content of fibrous material in the heated surplus drops to or below a preselected level.

The method can also comprise the steps of monitoring the quantity of fibrous material in the surplus and temporarily altering the rate of advancement of fibrous material from the source into the predetermined path as a function of changes in the quantity of fibrous material in the surplus.

Another feature of the invention resides in the provision of an apparatus for maintaining at a predetermined value the moisture content of fibrous material which is used in the tobacco processing industry. The apparatus comprises a source of fibrous material with a moisture content exceeding the predetermined value (the source can include a duct or a magazine for storage of a supply of shredded and/or otherwise comminuted tobacco leaves), means for advancing a flow of fibrous material from the source in a predetermined direction along a predetermined path, means (e.g., a conventional draping mechanism which confines a continuous tobacco stream in a web of cigarette paper to form a cigarette rod) for converting a portion of the flow into a smokers' product (such as the aforementioned cigarette rod or a series of cigarettes of unit length or multiple unit length which are obtained in response to severing of the rod) in a first portion of the path so that the remainder of the flow constitutes a surplus, a trimming device or other suitable means for removing the surplus from the flow in a second portion of the path upstream of the first portion, an infrared oven or other suitable means for heating the surplus so as to reduce its moisture content, and a system of conveyors and/or other suitable means for returning the heated surplus into a third portion of the path upstream of the second portion so that the moisture content of the flow between the third and second portions of the path is reduced, e.g., to the predetermined value. The apparatus preferably further comprises means (e.g., one, two or more moisture detectors) for monitoring the moisture content of fibrous material in the flow and for generating signals denoting the monitored moisture content, and means for adjusting the heating means in response to signals from the moisture detector or detectors. The adjusting means can comprise a regulator which can alter the rate of admission of energy to the heating means.

The advancing means can comprise one or more suction-operated conveyors defining a region or stretch of the path including the second portion (where the surplus is removed from the aforementioned portion of the flow).

The monitoring means can include at least one moisture detector which serves to monitor the moisture content of the surplus in the surplus returning means. Alternatively, or in addition to such detector, the means for monitoring the moisture content of fibrous material in the flow can comprise at least one moisture detector which is adjacent the suction-operated conveyor.

The advancing means can comprise adjustable metering means which serves to transfer fibrous material from the source into the predetermined path at a variable rate. Such apparatus can further comprise means for measuring the quantity of fibrous material in the surplus and for generating second signals denoting the measured quantity of fibrous material, and control means (e.g., a variable-speed transmission) for adjusting the metering means in response to second signals. The control means can be designed to adjust the metering means for a predetermined interval of time in response to reception of a second signal. The means for monitoring the moisture content of fibrous material in the flow which is advanced in such apparatus can comprise a moisture detector which measures the moisture content of fibrous material in the surplus and means for transmitting signals from the detector to the control means to influence the metering means as a function of the moisture content of fibrous material in the surplus. The signal transmitting means can comprise a processor which receives signals from the detector and from the quantity measuring means and transmits modified signals to the control means. The signal transmitting means can further comprise a threshold circuit which is installed between the detector and the processor and serves to transmit to the processor a fixed signal when the moisture content of fibrous material in the surplus drops to a preselected value. The threshold circuit can further transmit such signal to the adjusting means for the heating means when the moisture content of fibrous material in the surplus drops to the aforementioned preselected value. Such apparatus can further comprise means for measuring the density of the product and for transmitting corresponding signals to the processor and/or means for monitoring the moisture content of fibrous material upstream of the third portion of the path (e.g., in the source) and for transmitting corresponding signals to the processor to influence the control means for the metering means. The means for monitoring the moisture content of the flow in such apparatus can be disposed downstream of the third portion of the path and is or can be connected with the processor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a similar partly elevational and partly vertical sectional view of the stream building zone and a diagrammatic view of a modified apparatus; and.

DESCRIPTION OF THE PREFERRED EMBODIMENTS

Figure 1:
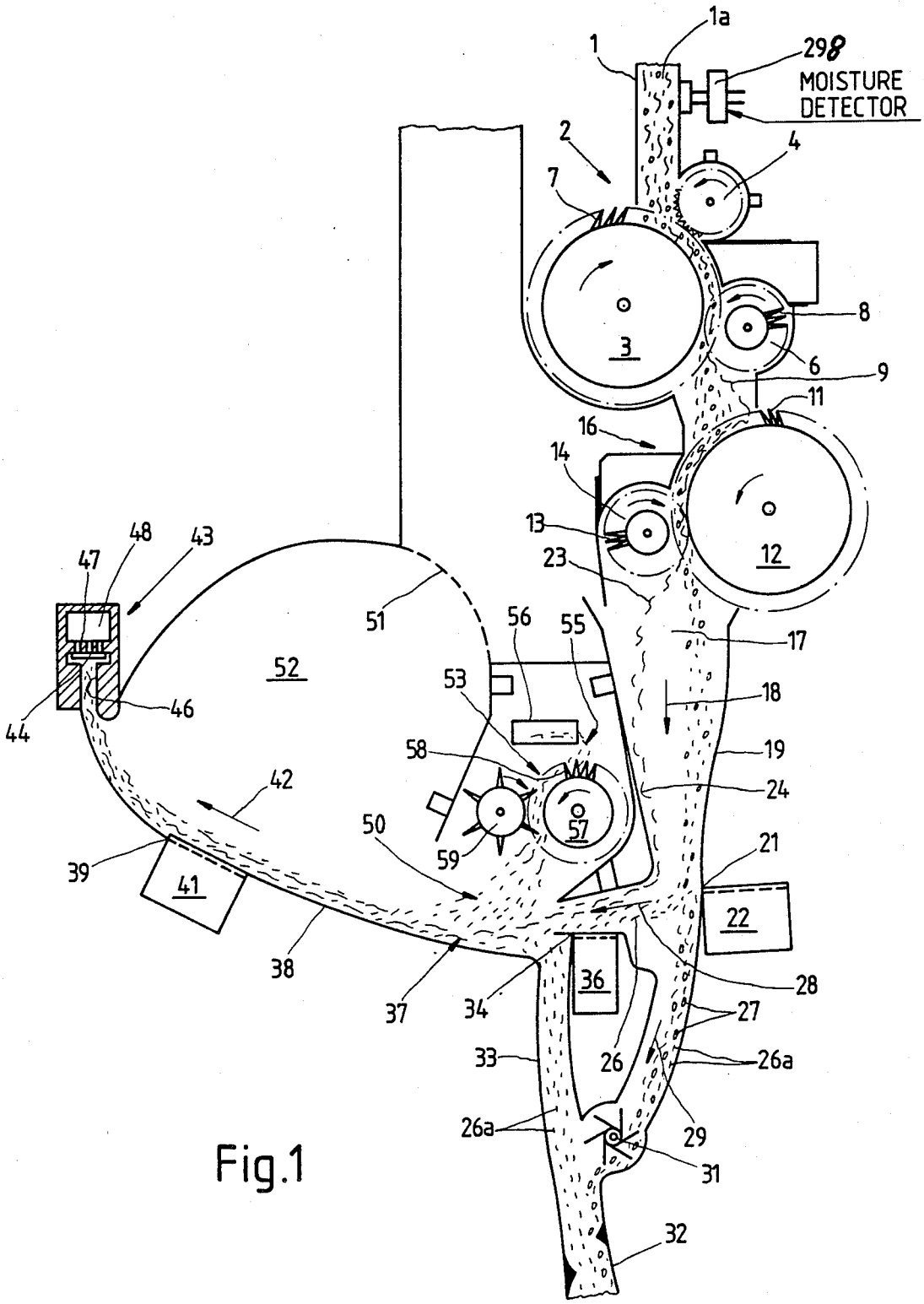
FIG. 1 is a schematic partly elevational and partly vertical sectional view of a distributor which forms part of a cigarette rod making machine and wherein heated and dried surplus tobacco is returned into the flow of tobacco which is to form the stream.

FIG. 1 shows the distributor (also called hopper) of a cigarette rod making machine, e.g., a machine known as PROTOS which is manufactured by the assignee of the present application. The distributor comprises an upright duct 1 which can be said to form part of or to constitute a source of supply of fibrous material and whose upper end receives batches of tobacco particles 1*a* in a manner as disclosed, for example, in commonly owned U.S. Pat. No. 4,185,644 to Heitmann (whose disclosure is incorporated herein by reference) as well as in numerous other patents and pending applications of the assignee.

The means for continuously drawing from the lower end of the duct 1 predetermined quantities of tobacco particles per unit of time comprises an adjustable metering device 2 including a drum-shaped carded conveyor 3, a metering wheel 4 downstream of the lower end of the duct 1 and a picker roller 6 downstream of the wheel 4. The RPM of the picker roller 6 greatly exceeds that of the conveyor 3. The carding 7 of the conveyor 3 comprises needles, and the periphery of the picker roller 6 is provided with radially extending pins 8. The purpose of the wheel 4 is to homogenize the layer of tobacco particles 1*a* which is withdrawn by the carding 7 of the conveyor 3, and the purpose of the picker roller 6 is to expel from the carding 7 a continuous shower 9 of tobacco particles 1*a* which descend onto the carding 11 of a rotary drum-shaped conveyor 12 forming part of a singularizing device 16. The layer of particles 1a which accumulate in the carding 11 is expelled by the pins 13 of a rapidly rotating picker roller 14 which converts the layer of particles 1*a* into a shower 17 of at least substantially separated discrete tobacco particles. The RPM of the conveyor 12 is or can be several times (e.g., between five and ten times) the RPM of the conveyor 3 so that, if the diameters of these conveyors are the same, the thickness of the layer of tobacco particles 1*a* in the carding 7 is a minute fraction of the thickness of the layer in the carding 11. Consequently, the particles which form the shower 9 are singularized during travel through the device 16 so as to allow for convenient and predictable classification of particles which form the shower 17. The direction of travel of particles which form the shower 17 is indicated by the arrow 18, and such particles enter a funnel-shaped classifying duct 19 wherein the heavier particles 27 are propelled to the right (as seen in FIG. 1) while the lighter particles 23, 34 remain adjacent the left-hand wall of the duct 19. The indicated trajectories of the heavier particles are determined by the pins 13 of the rapidly rotating picker roller 14.

A plenum chamber 22 is adjacent a horizontal branch of the duct 19 and discharges one or more jets of compressed classifying air by way of a nozzle 21 which compels the lighter particles 23 to advance in the direction of arrow 28 while permitting the heavier particles 27 (such as fragments of ribs) to descend in the direction of arrow 29. The lighter tobacco particles 23 contain longer shreds 24 and shorter shreds 26; such shreds are segregated from heavier particles 27 and advance in the direction of arrow 28. The heavier particles 27 entrain at least some lighter tobacco particles **26*a* which descend therewith in the direction of arrow 29 into the range of a gate 31 in the form of a driven cell wheel which allows the heavier particles 27 to leave the duct 19 and to enter a further classifying duct 32 for delivery to a suitable collecting receptacle, not shown. The lighter tobacco particles 26*a* which leave the duct 19 by way of the gate 31 are caused to rise in a pipe 33 under the injector effect of a nozzle 34 which discharges one or more jets of compressed air from a plenum chamber 36 to assist the mixture of lightweight particles 23, 24 and 26*a* in advancing along the concave upper side of a guide wall 38 and to form a relatively large mass or flow 37 which advances in the direction of arrow 42**.

Figure 2:
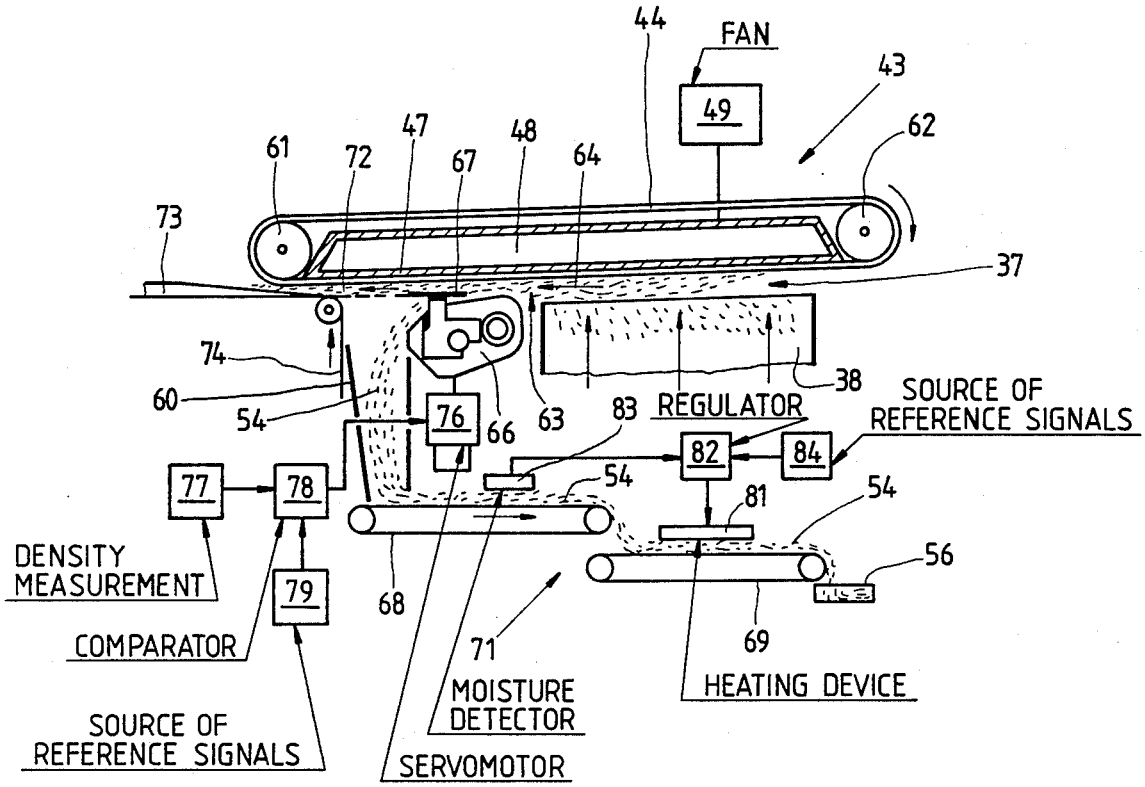
FIG. 2 is a schematic partly elevational and partly vertical sectional view of the stream building zone and a diagrammatic view of an apparatus which embodies one form of the invention.

The advancement of the flow 37 in the direction of arrow 42 is assisted by one or more jets of compressed air which issue from one or more nozzles 39 of a further plenum chamber 41 and have orifices adjacent the concave upper side of the guide wall 38. The location or station where the lightweight particles 23, 24 are mixed with lightweight particles **26*a* is indicated by an arrow 50; this is the locus of admission to the flow 37 of a stream 54 of heated surplus tobacco which is removed from the flow 37 in a manner as shown in FIG. 2**.

The flow 37 enters a stream building zone 43 which is defined in part by an endless foraminous belt conveyor 44 trained over pulleys 61, 62 (FIG. 2) at least one of which is driven to advance the lower reach or flight of the conveyor 44 in the direction of arrow 64. The lower reach of the conveyor 44 is disposed in the uppermost portion of an inverted U-shaped tobacco channel 46 which receives successive increments of the flow 37 and wherein the particles **1*a* of tobacco advance with the lower reach in the direction of arrow 64. The lower reach of the conveyor 44 is located below the air-permeable bottom wall 47 of an elongated suction chamber 48 which is connected to the intake of a fan 49 (FIG. 2) or another suitable suction generating device. The surplus of air (admitted by the nozzles 21, 34 and 39) is permitted to enter an expansion chamber 52 above the guide wall 38 and escapes from the chamber 52 through the interstices of a sieve 51**.

The means 53 for admitting heated (and hence dried) surplus tobacco 54 into the flow 37 at the mixing station 50 comprises an elongated vibratory conveyor 56 in the form of a trough which is open along one of its sides (at 55) to discharge a narrow but long stream of heated tobacco particles **1*a* (such stream extends at right angles to the plane of FIG. 1) onto the carding 58 of a drum-shaped conveyor 57 which accumulates a homogeneous layer of tobacco particles. Such particles are expelled from the carding 58 by the pins of a rapidly rotating picker roller 59 which propels the particles 1*a* of tobacco onto the flow 37 at the mixing station 50. The propelled particles form a shower which descends onto the upper side of the advancing flow 37 and is entrained toward and into the channel 46 to form part of a growing tobacco stream at the underside of the lower reach of the conveyor 44. The fully grown stream 63 is relieved of the surplus 54 by an adjustable trimming or equalizing device 66 which has one or more rotating disc-shaped knives 67 and can be moved up or down (i.e., toward and away from the lower reach of the conveyor 44) by a suitable servomotor 76 or other adjusting means. The length of the open side 55 of the vibrating trough-shaped conveyor 56 equals or approximates the width of the stream building zone 43, i.e., the width of the guide wall 38 at a level immediately below the right-hand portion of the lower reach of the conveyor 44, as seen in FIG. 2**.

The path along which the removed surplus 54 advances from the trimming or equalizing station (knife or knives 67) to the mixing station 50 is relatively short (i.e., much shorter than the path of travel of particles from the duct 1 to the cigarette rod forming station) and is defined in part by a chute 60 adjacent the trimming device 66, in part by an endless belt conveyor 68 which advances the surplus 54 from the lower end of the chute 60 onto a further endless belt conveyor 69, by the trough-shaped conveyor 56, by the carded conveyor 57 and by the picker roller 59. The conveyors 68, 69, 56 and the chute 60 constitute a means 71 for returning the surplus 54 into the flow 37, i.e., into the range of the carded conveyor 53 above the mixing station 50.

The trimmed or equalized stream 72 which advances beyond the trimming station is caused to enter a conventional wrapping or draping mechanism 73 wherein it is confined in a continuous web 74 of cigarette paper or other suitable wrapping material to be converted therewith into a continuous cigarette rod (smokers' product) which is subdivided by a cutoff (not shown) of known design to yield a succession of discrete plain cigarettes of unit length or multiple unit length.

The mass (density) of the filler of the cigarette rod is monitored by a suitable density or mass monitoring device 77 of any known design (e.g., a device including a source of beta rays at one side and an ionization chamber at the opposite side of the path of axial movement of the cigarette rod), and the signals which are generated by the ionization chamber are transmitted to a comparator 78 which further receives a reference signal from a source 79 (e.g., an adjustable potentiometer). The reference signal denotes the desired density of the filler of the cigarette rod. If the intensity or another characteristic of the signal from the density measuring device 77 deviates from the reference signal, the comparator 78 transmits a signal which causes the servomotor 78 to adjust the level of the trimming device 66 in a sense to remove a larger or a smaller quantity of surplus and to thus reduce or increase the density of the filler.

In accordance with a feature of the invention, the removed surplus 54 is dried in a controlled manner before it reaches the mixing station 50 so that it can reduce the moisture content of the flow 37 which advances toward the stream building zone 43. The means for drying the surplus 54 comprises an adjustable heating device 81 which is located at a level above the upper reach or flight of the endless belt conveyor 69 and which can constitute or comprise one or more infrared heaters. The heating action of the device 81 can be varied by an adjusting device 82 (hereinafter called regulator) in dependency on the moisture content of tobacco which forms the trimmed or equalized stream 72, in dependency on the moisture content of the untrimmed stream 63, in dependency on the moisture content of tobacco in the flow 37 upstream or downstream of the mixing station 54 and/or in dependency on the moisture content of the surplus. In the embodiment of FIGS. 1 and 2, the means for monitoring the moisture content of tobacco particles includes a moisture detector 83 (e.g., a detector operating with infrared lights and known as Quadrabeam) which is adjacent the path of advancement of surplus tobacco 54 along the upper reach or flight of the conveyor 68 immediately upstream of the conveyor 69 which cooperates with the adjustable heating device 81. Signals which are generated by the moisture detector 83 are compared with a reference signal which is transmitted by a source 84 of reference signals, and the regulator 82 (e.g., a suitable comparator) transmits to the heating device 81 a signal (to change the intensity of radiated heat and hence the moisture content of surplus tobacco 54) when the intensity or another characteristic of the signal from the source 84 deviates from the same characteristic of the signal which is generated by the moisture detector 83.

The thus heated and dried surplus tobacco 54 is admixed to the particles 23, 24, 26*a* of the flow 37 at the station 50 so as to ensure that the moisture content of the filler in the rod which is formed in the draping device 73 matches the desired value.

Figure 3:
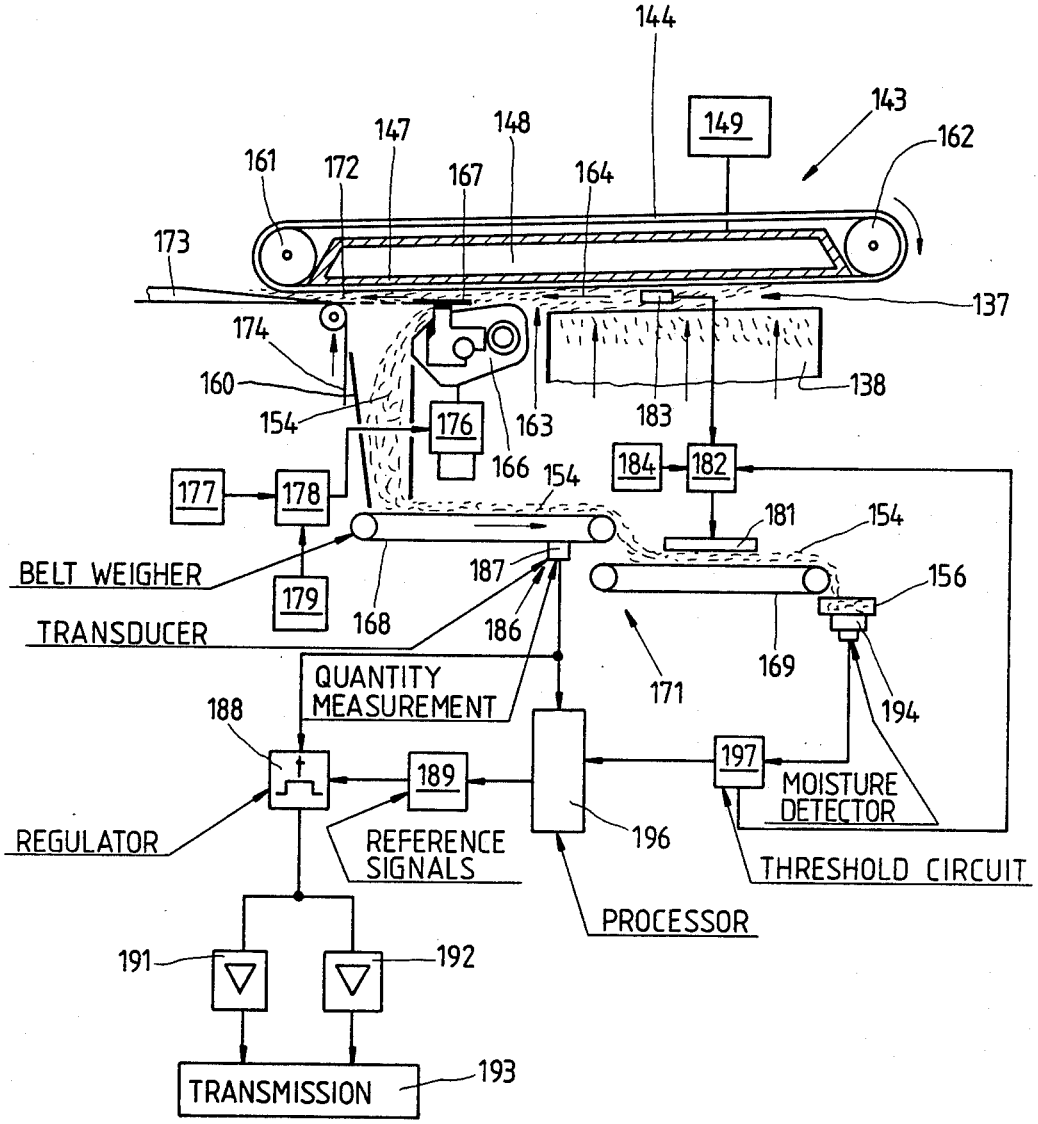

FIG. 3 shows a modified apparatus. All such parts of this apparatus which are identical with or clearly analogous to the corresponding parts of the apparatus of FIGS. 1–2 are denoted by similar reference characters plus 100. The moisture detector 183 is adjacent the flow 137 at the underside of the lower reach of the conveyor 144 and is connected to the corresponding input of the adjusting means or regulator 182 for the adjustable heating device 181. It is clear that the moisture detector 183 can be transferred to any one of several further locations, e.g., adjacent the trimmed or equalized stream 172, into the guide means 138 or into the duct 160.

In order to further enhance the quality and reliability of the heating and drying action which is performed by the device 181, the apparatus of FIG. 3 comprises means for measuring the quantity of the surplus 154 in order to regulate the operation of the tobacco advancing means including the adjustable metering device 2 with a view to further reduce the likelihood of deviation of moisture content of tobacco particles in the cigarette rod from a desired or optimum value. The means for measuring the quantity of tobacco in the surplus 154 comprises a conventional belt weigher 186, which includes the endless belt conveyor 168, and a transducer 187 which is responsive to changes in the inclination of the upper reach of the conveyor 168 and hence to changes in the quantity of tobacco particles which are about to reach the upper flight of the belt conveyor 169 below the adjustable heating device 181. The electric signal which is generated by the transducer 187 is transmitted to the corresponding input of a second regulator 188 which is a comparator wherein such signal is compared with a reference signal from a source 189. The polarity of the signal at the output of the regulator 188 determines whether such signal is transmitted to an amplifier 191 or to an amplifier 192 for an adjustable drive 193 (control means) which determines the speed of the carded conveyor 3 and/or metering wheel 4 in the adjustable metering device 2 forming part of the distributor of FIG. 1. The drive 193 can comprise a variable-speed transmission of any known design which is capable of increasing or reducing the RPM of the conveyor 3 and/or wheel 4 in response to signals from the amplifier 191 or 192. If the quantity of tobacco particles 1*a* in the surplus 154 is less than that selected by the reference signal from the source 189, the RPM of the conveyor 3 and/or roller 4 in increased so that the rate of withdrawal of particles 1*a* from the duct 1 is increased. The conveyor 3 and/or wheel 4 will be caused to reduce the rate of withdrawal of particles 1*a* from the duct 1 per unit of time if the intensity or another characteristic of the signal which is transmitted by the transducer 187 of the quantity measuring device 186 exceeds the corresponding characteristic of the reference signal from the source 189. This ensures that the combined quantity of fresh tobacco particles (coming from the funnel 19) and heated tobacco particles (coming from the duct 160) is at least substantially constant.

The RPM of the components of the adjustable metering device 2 is preferably synchronized with the RPM of the components of the singularizing device 16 so that the RPM of the conveyor 3 is changed simultaneously with the RPM of the conveyor 12 and (if desired or necessary) the RPM of the picker roller 6 is changed simultaneously with the RPM of the picker roller 14. The signal which is transmitted by the transducer 187 of the quantity or mass measuring device 186 to the drive (control means) 193 is or can be delayed in such a way that surplus tobacco which has caused a change in the intensity or another characteristic of the signal from the transducer 187 reaches the mixing station simultaneously with that portion of the freshly admitted tobacco which was withdrawn from the duct 1 in response to the modified signal from 187. In other words, heated surplus tobacco which reaches the station 50 is caused to be admixed to fresh tobacco which has been withdrawn from the duct 1 by the conveyor 3 and wheel 4 at a rate determined by the signal denoting the quantity of surplus tobacco at the station 50.

The just discussed features of the apparatus which is shown in FIG. 3 are particularly important when the moisture content of tobacco particles 1*a* entering the duct 1 varies within a wide range. This will be readily appreciated by bearing in mind that, as a rule, the moisture content of surplus tobacco which advances below the heating device 181 should not be reduced below a predetermined value, e.g., to not less than 10%. In other words, if the moisture content of tobacco particles 1*a* in the duct 1 is so high that it would be necessary to reduce the moisture content of the surplus 154 below 10%, it is necessary to find another mode of reducing the moisture content of the filler of the cigarette rod to a preselected optimum value. This is accomplished in that the apparatus of FIG. 3 then increases the quantity of surplus tobacco 154 to thus ensure that, when the larger quantity of surplus tobacco is heated so as to reduce its moisture content to not less than 10% or to another predetermined value, the overall moisture content of the flow 137 reaching the stream building zone 143 will be satisfactory because such flow will contain a larger percentage of dried surplus tobacco. To this end, the apparatus of FIG. 3 comprises a moisture (e.g., a capacitive moisture measuring device of known design) detector 194 which is adjacent the vibrating trough 156 of the surplus returning means 171 and transmits signals denoting the moisture content of dried surplus tobacco 154 which is on its way to the mixing station 50 of FIG. 1. The signals from the moisture detector 194 are transmitted to a threshold circuit 197 which has a first output connected to the regulator 182 and a second output connected to a suitable processor 196 whose output transmits signals serving to adjust the source 189 of reference signals for the regulator 188. The construction of the known per se threshold circuit 197 is such that it transmits a signal when the moisture content of dried tobacco particles in the vibrating trough 156 drops below a preselected value (e.g., 10%). The signal to the regulator 182 ensures that the heating action of the adjustable drying device 181 upon the surplus tobacco 154 then remains unchanged. The processor 196 receives signals from the threshold circuit 197 as well as from the transducer 187 and its output transmits signals which indirectly regulate the speed of the conveyor 3 and/or wheel 4 in such a way that the quantity of tobacco particles 1*a* which descend into the funnel 19 and reach the stream building zone 143 is increased, i.e., the quantity of the surplus 154 increases and the moisture content of dried tobacco entering the trough 156 also increases because the regulator 182 (in response to a signal from the threshold circuit 197) prevents any changes in the heating action of the adjustable drying device 181 upon the stream of surplus tobacco 154. The increasing moisture content of the surplus tobacco 154 which enters the trough 156 is detected by the detector 194 which, in turn, transmits a corresponding signal to the threshold circuit 197 which releases the regulator 182 so that the latter is free to alter the heating action of the drying device 181 as soon as the ascertained moisture content of the surplus 154 has risen above the lower threshold value selected by the circuit 197. The parts 196 and 197 can be said to constitute a means for transmitting signals from the detector 194 to the control means 193 for the adjustable metering device 2.

Figure 4:
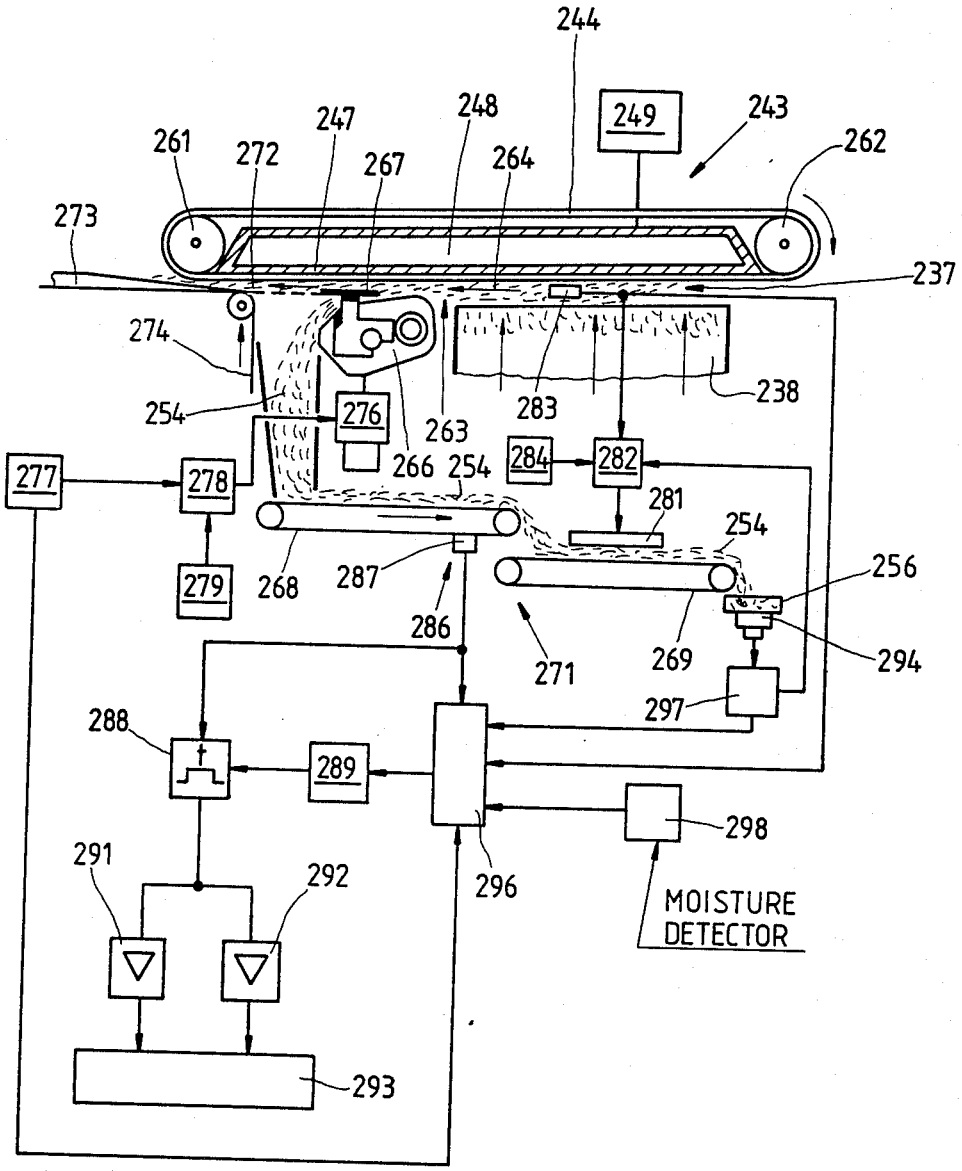
FIG. 4 is a similar partly elevational and partly vertical sectional view of the stream building zone and a diagrammatic view of a third apparatus.

FIG. 4 shows a third apparatus wherein all such parts which are identical with or analogous to the corresponding parts of the apparatus of FIG. 3 are denoted by similar reference characters plus 100. In this apparatus, the rate at which tobacco particles are drawn from the duct 1 by the conveyor 3 and/or wheel 4 (as a function of adjustment of the control means or drive 293) is regulated as a function of one or more additional parameters which can influence the moisture content of the filler in the cigarette rod. The processor 296 (e.g., a commercially available microprocessor) receives signals from the threshold circuit 297, from the transducer 287, from the moisture detector 283, from the density measuring device 277, and from a device 298 which measures the moisture content of tobacco particles 1*a* in the duct 1 of the distributor in the cigarette rod making machine, i.e., upstream of that (third) portion of the path for the flow 237 where the flow receives the surplus 254. The device 298 can constitute or comprise a capacitive moisture detector of conventional design. The processor 296 evaluates all incoming signals and transmits (when necessary) a signal to the adjustable source 289 of reference signals for the regulator (comparator) 288 which adjusts the drive 293 by way of the amplifier 291 or 292.

In accordance with presently preferred embodiments of the invention, the moisture content of the flow 37, 137 or 237 is measured somewhere between the source (such as the duct 1) and the station(73, 173or 273) where the portion 72, 172 or 272 of the flow 37, 137 or 237 is converted into a smokers' product. However, and as shown in FIGS. 1 and 4, it is also within the purview of the invention to monitor the moisture content of fibrous material 1*a* well ahead of the location (station 50) where the heated surplus is returned to the flow, and to influence the rate of advancement of fibrous material from the source into the elongated path for the flow as a function of changes in the moisture content which is determined by the detector 298. As a rule, the moisture content will not be measured in a magazine of the type disclosed in German Offenlegungsschrift No. 22 11 520.

An important advantage of the feature that the path for the surplus 54, 154 or 254 is shorter (and preferably much shorter) than the elongated path for the surplus 37, 137 or 237 between the duct 1 and the draping mechanism 73, 173 or 273 is that the fibrous material 1*a* of the surplus is not subjected to excessive mechanical stresses which could result in undue comminution of such material, especially in view of the fact that its moisture content is relatively low and, therefore, the fibrous material of the surplus is (or is likely to be) more brittle than the overly moisturized fibrous material which advances from the source to the mixing station. As shown in FIGS. 1 and 2, the surplus (54) is merely transported through a duct 60, by two endless belt conveyors 68, 69, by the vibratory trough 56 and, if necessary, by the carded conveyor 57 which is optional and serves primarily to ensure more satisfactory distribution of heated fibrous material coming from the adjustable heating device 81 over the fibrous material which is delivered by the funnel 19 and pipe 33. At any rate, it is desirable to keep the number of devices which could subject heated fibrous material to mechanical stresses (especially pronounced mechanical stresses) to a minimum. Such devices include, among others, needles, pins and like parts which are likely to comminute the fibrous material.

Monitoring of the moisture content of the surplus 54 ahead of the heating device 81 is tantamount to monitoring of the moisture content of the flow of fibrous material that advances from the duct 1 toward the draping device 73 in the direction which is indicated by the arrows 18, 42 and 64 and along the path which is defined by the metering device 2, singularizing device 16, funnel 19, guide wall 38, channel 46 and suction-operated conveyor 44. Such monitoring by the moisture detector 83 is just as satisfactory as that by the detector 183 or 283, i.e., in the region of that part of the elongated path for the flow 137 or 237 which is defined by the suction-operated conveyor 144 or 244. The moisture detector or detectors which are used in the apparatus of the present invention can be of any design as long as they are capable of ascertaining the moisture content of the fibrous material in a portion of or in the entire flow with a requisite degree of accuracy. It is presently preferred to employ capacitive moisture detectors and/or moisture detectors which ascertain the conductivity of the fibrous material. The measurement can take place in the channel 46, in the duct 60, in that portion of the path which is intended for the advancement of the trimmed or equalized stream 72, 172 or 272, between the metering device 2 and singularizing device 16 and/or elsewhere.

The apparatus of FIGS. 3 and 4 can be used with particular advantage if the initial moisture content of fibrous material is high or very high so that the difference between such initial moisture content and the desired moisture content of the smokers' product or products is very pronounced. As explained above, the moisture content of the surplus cannot be reduced at will, e.g., to compensate for very pronounced differences between the initial moisture content and the moisture content of a cigarette rod, by the sole expedient of heating (drying) the surplus. In such instances, the circuit which includes the means (186, 286) for measuring the quantity of fibrous material in the surplus 154 or 254 influences the control means 193 or 293 to alter the rate of admission of fibrous material 1*a* from the source 1 into the path for the flow 137 or 237. Such method of regulating the reduction of the moisture content of fibrous material in the flow 137 or 237 can be rendered even more reliable by using the threshold circuit 197 or 297 which transmits a signal as soon as the moisture content of fibrous materiel 1*a* in the surplus 154 or 254 downstream of the adjustable heating device 181 or 282 (note the moisture detectors 194 and 294) has dropped to a predetermined minimum acceptable value. At such time, the circuit 197 or 297 transmits a signal which alters the intensity or another characteristic of the reference signal from the source 189 or 289. This entails a change in the quantity of fibrous material in the surplus 154 or 254 so that the moisture content of dried surplus increases and the signal at the output of the threshold circuit 197 or 297 can disappear.

The accuracy of the moisture regulating action can be enhanced still further if the processor (296) can alter the reference signal from the source 289 in dependency on one or more additional parameters which can be monitored to influence the moisture content. Thus, the processor 296 receives signals from the density measuring means 277 which is adjacent the path of the cigarette rod. Such signals influence the signal which is transmitted to the source 289 of reference signals in addition to those signals which are transmitted by the moisture detectors 283, 294 (via threshold circuit 297) and 298. The threshold circuits 197 and 297 constitute optional but desirable and advantageous elements of the apparatus which are shown in FIGS. 3 and 4 because they invariably prevent very pronounced drying of the surplus 154 or 254 to an extent which could entail excessive loss of elasticity and resulting brittleness with attendant increase in the percentage of short tobacco, tobacco dust and other undesirable constituents. As mentioned above, the threshold circuit 197 or 297 not only influences the signal at the output of the respective processor 196 or 296 but such signal also prevents the adjusting device 187 or 282 from further intensifying the heating action upon the surplus 154 or 254.

The regulator 288 is preferably designed to permit the control means to alter the rate of advancement of fibrous material 1*a* from the source 1 for selected intervals of time so as to reduce the likelihood of excessive oscillations of the regulating operation.

All embodiments of the improved apparatus exhibit the advantage that the energy requirements of the heating or drying means are low because it is merely necessary to heat a part (remainder) of the flow which advances from the source toward the station for the making of smokers' products. Thus, if the heating results in increased brittleness of the respective portion of the flow, only a portion of the flow is affected while the moisture content of a large percentage of fibrous material can remain high all the way to and beyond the surplus removing station. Moreover, the moisture content of the smokers' products can be regulated and maintained at a desired value with a very high degree of accuracy and predictability.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of maintaining at a predetermined value the moisture content of fibrous material which is used in the tobacco processing industry, comprising the steps of establishing and maintaining a supply of fibrous material with a moisture content exceeding said predetermined value; advancing a flow of fibrous material from the source in a predetermined direction along a predetermined path; converting a portion of the flow into a smokers' product in a first portion of said path so that the remainder of the flow constitutes a surplus; removing the surplus in a second portion of said path upstream of said first portion; heating the surplus so as to reduce its moisture content; and returning the heated surplus into a third portion of said path upstream of said second portion so that the heated surplus with its reduced moisture content is added to the advancing flow.

2. The method of claim 1, further comprising the step of monitoring the moisture content of fibrous material in the flow, said heating step including expelling from the surplus moisture at a rate which is a function of the monitored moisture content.

3. The method of claim 2, wherein said returning step includes continuously transporting the surplus along a second path from the second to the third portion of said predetermined path.

4. The method of claim 3, wherein said predetermined path is elongated and said second path is substantially shorter than said predetermined path.

5. The method of claim 2, wherein said monitoring step includes measuring the moisture content of the surplus.

6. The method of claim 2, wherein said advancing step includes advancing the flow by suction in a region of said path which includes said second portion, said monitoring step including measuring the moisture content of the flow in said region.

7. The method of claim 2, further comprising the steps of measuring the quantity of fibrous material in the surplus and advancing the fibrous material from the source at a rate which is a function of the quantity of fibrous material in the surplus.

8. The method of claim 7, further comprising the steps of monitoring the moisture content of fibrous material in the heated surplus and altering the rate of advancement of fibrous material from the source when the moisture content of the heated surplus drops below a preselected value so that the quantity of fibrous material in the surplus is changed as a result of said altering step.

9. The method of claim 7, further comprising the steps of monitoring the quantity of fibrous material in the product and changing the rate of advancement of fibrous material from the source as a function of changes in the monitored quantity of fibrous material in the product so that the quantity of fibrous material in the surplus is changed accordingly.

10. The method of claim 2, wherein said monitoring step includes measuring the moisture content of fibrous material (a) ahead of said second portion of the predetermined path and (b) in the surplus ahead of said third portion of the predetermined path, and further comprising the step of changing the rate of advancement of fibrous material from the source in response to changes in the measured moisture content to thereby change the quantity of fibrous material in the surplus.

11. The method of claim 2, wherein said monitoring step includes measuring the moisture content of fibrous material in the heated surplus and said expelling step includes maintaining the heating action at a fixed value when the moisture content of fibrous material in the heated surplus drops to a preselected level.

12. The method of claim 2, further comprising the steps of monitoring the quantity of fibrous material in the surplus and temporarily altering the rate of advancement of fibrous material from the source into said predetermined path as a function of changes of the quantity of fibrous material in the surplus.

13. Apparatus for maintaining at a predetermined value the moisture content of fibrous material which is used in the tobacco processing industry, comprising a source of fibrous material with a moisture content exceeding said predetermined value; means for advancing a flow of fibrous material from said source in a predetermined direction along a predetermined path; means for converting a portion of the flow into a smokers' product in a first portion of said path so that the remainder of the flow constitutes a surplus; means for removing the surplus from the flow in a second portion of said path upstream of said first portion; means for heating the surplus so as to reduce its moisture content; and means for returning the heated surplus into a third portion of said path upstream of said second portion so that the heated surplus with its reduced moisture content is added to the advancing flow.

14. The apparatus of claim 13, wherein said heating means is adjustable and further comprising means for monitoring the moisture content of fibrous material in the flow and for generating signals denoting the monitored moisture content, and means for adjusting said heating means in response to said signals.

15. The apparatus of claim 14, wherein said advancing means includes a suction-operated conveyor defining a region of said path including said second portion.

16. The apparatus of claim 15, wherein said monitoring means comprises at least one moisture detector adjacent said suction-operated conveyor.

17. The apparatus of claim 14, wherein said monitoring means includes at least one moisture detector arranged to monitor the moisture content of fibrous material in the surplus on said returning means.

18. The apparatus of claim 14, wherein said advancing means comprises adjustable metering means arranged to transfer fibrous material from said source into said path at a variable rate and further comprising means for measuring the quantity of fibrous material in the surplus and for generating second signals denoting the measured quantity, and control means for adjusting said metering means in response to said second signals.

19. The apparatus of claim 18, wherein said control means includes means for adjusting said metering means for a predetermined interval of time in response to reception of a second signal.

20. The apparatus of claim 18, wherein said monitoring means comprises a moisture detector arranged to measure the moisture content of fibrous material in the surplus and means for transmitting signals from said detector to said control means to influence said metering means as a function of the moisture content of fibrous material in the surplus.

21. The apparatus of claim 20, wherein said signal transmitting means comprises a processor which receives signals from said detector and from said measuring means and transmits signals to said control means.

22. The apparatus of claim 21, wherein said signal transmitting means further includes a threshold circuit connected between said detector and said processor and arranged to transmit to the processor a fixed signal when the moisture content of fibrous material in the surplus drops to a preselected value.

23. The apparatus of claim 21, further comprising means for measuring the density of the product and for transmitting corresponding signals to said processor.

24. The apparatus of claim 21, further comprising means for monitoring the moisture content of fibrous material upstream of said third portion of said predetermined path and for transmitting corresponding signals to said processor.

25. The apparatus of claim 24, wherein said means for monitoring the moisture content of fibrous material in the flow includes a further moisture detector disposed downstream of the third portion of said path and connected with said processor.

26. The apparatus of claim 21, wherein said signal transmitting means further includes a threshold circuit connected between said detector and said processor and arranged to transmit to the processor and to said adjusting means a fixed signal when the moisture content of fibrous material in the surplus drops to a preselected value.

* * * * *